US005747724A

United States Patent [19]

Lindgren et al.

[11] Patent Number: 5,747,724

[45] **Date of Patent: *May 5, 1998**

[54] SHOT PELLETS FOR GAME HUNTING ON WET MARSHLANDS AND METHOD OF MANUFACTURING SUCH SHOT

[75] Inventors: Per-Olov Lindgren, Fauske, Norway; Karl-Erik Johansson, Skellefteå, Sweden; Kjell-Åke Johansson, Skellefteå , Sweden; Karin Paulsson, Skelleftehamn, Sweden

[73] Assignee: Boliden Mineral AB, Skelleftehamn, Sweden

[21] Appl. No.: 727,500

[22] Filed: Oct. 23, 1996

[ * ] Notice: The term of this patent shall not extend beyond the expiration date of Pat. No. 5,528,988.

[30] Foreign Application Priority Data

Mar. 28, 1995 [SE] Sweden ..... 9501125

[51] Int. Cl.[6] ..... F42B 7/04

[52] U.S. Cl. ..... 102/459; 102/514; 29/1.23

[58] Field of Search ..... 102/448, 459, 102/501, 514, 516; 29/1.22, 1.23

[56] References Cited

U.S. PATENT DOCUMENTS

| | | | |
|---|---|---|---|
| 1,674,112 | 6/1928 | Hering | 29/1.22 |
| 3,125,794 | 3/1964 | Reynolds | 29/1.22 |
| 3,400,660 | 9/1968 | Malter | 102/459 |
| 5,422,085 | 6/1995 | Bell et al. | 423/213.5 |

*Primary Examiner*—Harold J. Tudor
*Attorney, Agent, or Firm*—Burns, Doane, Swecker & Mathis

[57] ABSTRACT

The invention relates to shot pellets for hunting in wet marshlands or corresponding wet areas. The shot has an inner core of copper or copper alloy and an outer layer of silver or silver alloy. No heavy metal will leach from the shot into the environmental surroundings, and the shot has no toxic effect on birds, even should they ingest a considerable quantity of shot. The shot is produced by granulating copper or copper alloy electrochemically to obtain shot cores, whereafter at least one layer is applied thereto. The outer layer always consists of silver or a silver alloy.

6 Claims, 1 Drawing Sheet

SHOT PELLETS FOR GAME HUNTING ON WET MARSHLANDS AND METHOD OF MANUFACTURING SUCH SHOT

BACKGROUND OF THE INVENTION

The present invention relates to shot, such as BB-shot pellets, for hunting on wet marshlands, particularly for hunting birds, and to a method of manufacturing such shot.

Large numbers of lead shot pellets are used worldwide in the hunting of birds. The majority of the pellets fail to hit the target and fall relatively undamaged to the ground or settle on the bottom of waterways and lakes, and there accumulate over the passage of time. When hunting on wet marshlands for instance, shot will accumulate within areas that are highly frequented by water fowl, such as wild duck and similar birds, for instance.

Investigations have shown that over the last decennium, wild fowl and ducks in particular have shown signs of lead poisoning. It has been established that the birds ingest lead pellets from the ground or from the bottom of rivers and lakes in their search of food and also in search of grit to assist in digestion of the food ingested.

The lead pellets remain in the gizzard of the birds for from 7–15 calendar days. The gastric juices produced by birds are highly acid, having a pH of about 1, and consist mainly of hydrochloric acid, and consequently large quantities of lead are leached from the pellets. The leached lead then travels through the blood vessels to vital body organs, causing suffering and, in many cases, the death of the bird concerned. According to scientific research, the ability of such creatures to reproduce is also effected by the ingestion of lead. The risk increases in areas that are densely populated by water fowl where hunting is very intensive.

In order to avoid lead poisoning of birds, more and more countries have totally prohibited the use of lead shot at least for hunting on wet marshlands and on rivers and lakes. The present-day alternative to lead shot is iron or steel shot. Bismuth shot is also available, although in very limited quantities. Iron and steel shot, however, are encumbered with other serious drawbacks, and hunters are very much against the use of such shot. Among other things, the density of steel and iron shot is 30% lower than the density of lead shot and therefore requires a larger amount of propellant, with the risk of splitting the gun barrel. Furthermore, iron and steel shot have a poorer penetrating force than lead shot, resulting in a larger number of woundings. In addition, steel and iron shot subject the gun barrels to much greater wear. Sparking caused by ricochets when hunting with iron or steel shot also present a serious risk, for instance a serious fire risk.

Our earlier publication WO 94/08199, which is herewith incorporated by reference, proposes a silver-plated lead pellet with which leaching of lead to the surroundings is highly negligible and with which dissolution of lead in the stomachs of birds, particularly the gizzard, is greatly reduced in comparison with other known coated or plated lead shot. However, because of the extremely harsh abrasive effect to which the shot is subjected in the gizzards of birds, it cannot be excluded that silver-plated lead shot, even when densely coated with silver, will not be ground down to an extent in which lead is able to leach from the shot before the shot residues are expelled from the gizzard after 7–15 calendar days, perhaps even after a longer time. Thus, the authorities may be justified in totally prohibiting the use of all lead shot, including silver-plated shot, in extremely sensitive wet marshlands or water areas, even though the risk of water fowl being subjected to lead poisoning is very small when using our earlier silver-plated lead shot, as evident from said patent publication. Since no lead will be leached from the silver-plated shot onto firm ground, the shot is in all events highly suited for use in forests and woodlands (dry hunting).

Thus, there is a need for shot which can be used for hunting birds on wet marshlands and corresponding areas and which will provide a substitute for lead-based shot while possessing all the good properties of lead shot to the greatest possible extent, compared with hitherto known alternative shot, while, at the same time, totally eliminating the drawbacks of lead poisoning of water fowl described in the introduction, and also the risk of the leaching of heavy metals to the surroundings.

SUMMARY OF THE INVENTION

The present invention surprisingly makes possible the production of a shot that can be used for hunting wild fowl on wet marshlands and corresponding areas and which does not contain lead and which nevertheless has good shooting characteristics, and with which the risk of heavy metal leaching out into the soil and the risk of water fowl being subjected to lead poisoning are essentially totally eliminated, even though the birds were to ingest a large amount of fallen shot when seeking food or grit to assist their digestive processes.

Characteristic features of the invention will be apparent from the following claims.

The inventive shot thus includes an inner core of copper or copper alloy, and an outer layer of silver or silver alloy that has been applied electrochemically.

Figure 1:
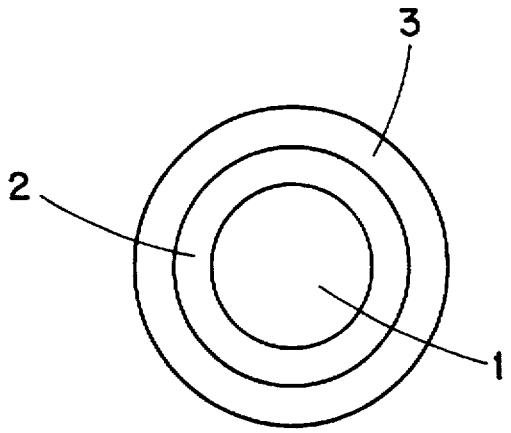
FIG. 1 illustrates a cross section (not to scale) of one embodiment of a shot pellet according to the present invention.

The shot is produced by granulating copper or a copper alloy to form spherical cores (1 of FIG. 1) which are coated electrochemically with one or more layers (2 of FIG. 1) that completely covers or cover the copper surface, wherein the outer layer (3 of FIG. 1) always consists of silver or a silver alloy applied in a thin dense layer over the copper surface.

The shot cores are suitably pretreated by cleaning and activation, with or without an intermediate layer.

One advantageous and simple method is to coat the shot cores with one or more layers by means of a continuous electrochemical plating process using an alkaline cyanide-based electrolyte.

Final manufacture, i.e. manufacture starting from granulated copper cores, can be carried out in the same apparatus as that used to produce silver-lead shot.

The inventive silver-plated copper shot has all the positive features of silver-plated lead shot, among other things because silver and copper are more closely related electrochemically than silver and lead, and consequently shot comprising a silver layer applied electrolytically to a copper surface has the same or better properties than corresponding silver-plated lead shot, and gives the same or better results. Furthermore, the density of copper lies closer to the density of lead than does the density of iron, which is highly advantageous in comparison with the use of the iron shot alternative. The problems discussed in the introduction with regard to the shooting characteristics of iron shot are thus greatly alleviated by copper shot.

The mechanical properties of the silver layer, and therewith its ability to form a dense, almost inert layer, which prevents any form of leakage of heavy metal to the surroundings, are retained to the full when using copper cores instead of lead cores, as has been shown by comparison tests.

At those leaching rates observed in the tests reported with regard to plated lead shot in the examples of our earlier publication WO 94/08199 and which can reasonably be assumed to apply in the present case, conservationists are able to exclude almost totally the risk of birds being poisoned by the shot, even though they may ingest considerable quantities of the shot and retain it over a long period of time. This is because copper is much less toxic than lead.

Similar to our earlier silver-plated lead shot, no heavy metal will leak into the soil or onto the ground, because the silver coating has the same adherence to the copper surface as to the lead surface, and because it has plastic properties similar to copper.

The inventive silver-plated copper shot possesses a unique combination of the effective properties demanded of shot pellets that are to be used for hunting in wet marshlands or territories frequented by water fowl.

Although the inventive shot has excellent firing properties, its most important properties reside in its complete environmental safety, since there is no risk of heavy metal leaching out in the natural surroundings and therewith no risk of poisoning birds which might ingest shot that has fallen onto the ground or has settled onto the bottom of a lake or river for instance. It is therefore believed that nature conservancy authorities will find no reason to prohibit the use of the inventive shot, not even for hunting in very sensitive areas, primarily wet marshlands which are heavily frequented by wild fowl and other species of birds.

We claim:

1. Shot pellets for hunting on wet marshlands and corresponding wet areas, characterized by an inner core of copper or copper alloy and an outer layer of silver or silver alloy applied electrochemically thereto and entirely covering the copper surface of the inner core.

2. Shot according to claim 1, characterized in that the outer layer of silver or silver alloy has a thickness of 10–15 μm.

3. A method of producing a shot pellet for hunting on wet marshlands and corresponding wet areas, wherein the shot pellet comprises an inner core of copper or copper alloy and an outer layer of silver or silver alloy applied electrochemically thereto and entirely covering the copper surface of the inner core, said method comprising granulating copper or copper alloy to produce spherical shot cores, and covering the entire copper surface electrochemically with at least one layer, wherein the outer layer always consists of silver or silver alloy.

4. A method according to claim 3, wherein the silver or silver alloy coating is applied electrolytically with the use of an alkaline cyanide-based electrolyte.

5. A method of producing a shot pellet for hunting on wet marshlands and corresponding wet areas, wherein the shot pellet comprises an inner core of copper or copper alloy and an outer layer of having a thickness of 10–15 μm of silver or silver alloy applied electrochemically thereto and entirely covering the copper surface of the inner core, said method comprising granulating copper or copper alloy to produce spherical shot cores, and covering the entire copper surface electrochemically with at least one layer, wherein the outer layer always consists of silver or silver alloy.

6. A method according to claim 5, wherein the silver or silver alloy coating is applied electrolytically with the use of an alkaline cyanide-based electrolyte.

* * * * *

UNITED STATES PATENT AND TRADEMARK OFFICE

CERTIFICATE OF CORRECTION

PATENT NO. : 5,747,724

DATED : May 5, 1998

INVENTOR(S) : Lindgren et al

It is certified that error appears in the above-identified patent and that said Letters Patent is hereby corrected as shown below:

On the title page, add the following references;

U.S. Patent Documents:

| | | |
|---|---|---|
| 5,088,415 | 2/92 | Huffman et al |
| 5,528,988 | 6/96 | Lindgren et al |

Foreign Patent Documents:

| | | |
|---|---|---|
| 2,111,176 | 6/83 | United Kingdom |
| WO 94/08199 | 4/94 | WIPO |

Signed and Sealed this

Ninth Day of March, 1999

*Attest:*

Q. TODD DICKINSON

*Attesting Officer*

*Acting Commissioner of Patents and Trademarks*